US009853354B2

(12) United States Patent
Koyama

(10) Patent No.: US 9,853,354 B2
(45) Date of Patent: Dec. 26, 2017

(54) SLEEVE ANTENNA AND WIRELESS COMMUNICATION DEVICE

(71) Applicant: Seiko Epson Corporation, Shinjuku-ku (JP)

(72) Inventor: Shunsuke Koyama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 14/384,950

(22) PCT Filed: Mar. 13, 2013

(86) PCT No.: PCT/JP2013/001676
§ 371 (c)(1),
(2) Date: Sep. 12, 2014

(87) PCT Pub. No.: WO2013/136794
PCT Pub. Date: Sep. 19, 2013

(65) Prior Publication Data

US 2015/0048987 A1 Feb. 19, 2015

(30) Foreign Application Priority Data

Mar. 15, 2012 (JP) ..... 2012-058330

(51) Int. Cl.
*H01Q 1/36* (2006.01)
*H01Q 9/30* (2006.01)
(Continued)

(52) U.S. Cl.
CPC ..... *H01Q 1/36* (2013.01); *H01Q 1/243* (2013.01); *H01Q 9/26* (2013.01); *H01Q 9/30* (2013.01); *H01Q 9/42* (2013.01)

(58) Field of Classification Search
CPC H01Q 1/36; H01Q 1/243; H01Q 9/26; H01Q 9/42; H01Q 9/16; H01Q 9/30
(Continued)

(56) References Cited

U.S. PATENT DOCUMENTS 5,248,988 A * 9/1993 Makino ..... H01Q 5/40 343/715
5,448,253 A * 9/1995 Ponce de Leon ..... H01Q 1/243 343/702
(Continued)

FOREIGN PATENT DOCUMENTS

CN 2566473 Y 8/2003
EP 0 635 898 A1 1/1995
(Continued)

OTHER PUBLICATIONS

Supplementary European Search Report, dated Oct. 19, 2015, of the corresponding European Application No. 13760365.0.; (6 pages).

*Primary Examiner* — Dameon E Levi
*Assistant Examiner* — Ab Salam Alkassim, Jr.
(74) *Attorney, Agent, or Firm* — Kilpatrick Townsend & Stockton LLP

(57) ABSTRACT

To provide a sleeve antenna that can be attached to a chassis while maintaining favorable antenna gain even when using a small circuit board, and a wireless communication device.

The sleeve antenna includes: a coaxial feed line 12; a radiating portion 14 that has a predetermined length and results from removing an outer conductor 30 at a tip portion of the coaxial feed line 12; and a sleeve 10 that has a predetermined length and covers the coaxial feed line 12 from a proximal end of the radiating portion 14 toward a direction opposite to the radiating portion 14. At least one of the radiating portion 14 and the sleeve 10 has a bent portion 36 in at least a portion thereof.

5 Claims, 7 Drawing Sheets

(51) Int. Cl.
*H01Q 9/26* (2006.01)
*H01Q 1/24* (2006.01)
*H01Q 9/42* (2006.01)

(58) Field of Classification Search
USPC ..... 343/790, 791, 792
See application file for complete search history.

(56) References Cited

U.S. PATENT DOCUMENTS 5,565,880 A * 10/1996 Wang ..... H01Q 9/16 343/789
5,805,112 A * 9/1998 Cassel ..... H01Q 1/242 343/702
5,852,422 A * 12/1998 Imanishi ..... F16D 65/0006 343/702
6,177,911 B1 * 1/2001 Yuda ..... H01Q 1/246 343/790
6,337,666 B1 * 1/2002 Bishop ..... H01Q 9/30 343/700 MS
6,765,539 B1 * 7/2004 Wang ..... H01Q 1/38 343/700 MS
6,842,155 B1 * 1/2005 Yeh ..... H01Q 9/42 343/790
7,193,570 B2 * 3/2007 Liu ..... H01Q 1/084 343/700 MS
7,373,169 B2 5/2008 Yoshino
7,969,371 B2 * 6/2011 Yun ..... H01Q 9/14 343/702
8,487,827 B2 * 7/2013 Mukai ..... H01Q 9/30 343/790
8,780,011 B2 * 7/2014 Yoshino ..... H01Q 1/3291 343/711
8,872,726 B2 * 10/2014 Kusanagi ..... H01Q 1/243 343/909
8,957,815 B2 * 2/2015 Chiu ..... H01Q 1/24 343/702
2002/0158807 A1 * 10/2002 Kuramoto ..... H01Q 3/12 343/791
2005/0134516 A1 * 6/2005 Du ..... H01Q 1/22 343/790
2006/0001579 A1 * 1/2006 Noro ..... H01Q 7/00 343/702
2008/0068276 A1 * 3/2008 Noro ..... H01Q 1/243 343/791
2010/0085267 A1 * 4/2010 Yun ..... H01Q 1/242 343/791
2010/0149069 A1 6/2010 Kim
2012/0319914 A1 * 12/2012 Sakuma ..... H01Q 9/22 343/790
2015/0029059 A1 * 1/2015 Grossman ..... H01Q 1/243 343/702

FOREIGN PATENT DOCUMENTS

JP 1-120108 A 5/1989
JP 08-008627 A 1/1996
JP 08-172374 A 7/1996
JP 09-252212 A 9/1997
JP 2001-168786 A 6/2001
JP 2002-141732 A 5/2002
JP 2005-064742 A 3/2005
JP 2005-348252 A 12/2005
JP 2006-050517 A 2/2006

* cited by examiner

SLEEVE ANTENNA AND WIRELESS COMMUNICATION DEVICE

This application is a U.S. National Phase Application of International Application No. PCT/JP2013/001676, filed Mar. 13, 2013, which claims priority to Japanese Patent Application No.: 2012-058330, filed Mar. 15, 2012, the entireties of which are all hereby incorporated by reference.

TECHNICAL FIELD

The present invention relates to a sleeve antenna and a wireless communication device.

BACKGROUND ART

As one kind of antenna used for communications using electromagnetic waves at frequencies in or higher than the VHF band, a sleeve antenna has been conventionally known. As the simplest structure of this sleeve antenna, a sleeve antenna 50 shown in FIG. 9 has been known.

For this sleeve antenna 50, a sleeve antenna has been known in which a radiating portion 14 is formed by leaving only a core conductor 20 including an insulating member 18 as an outer skin at an end portion of a coaxial feed line 12, which is referred to generally as a coaxial cable, and an outer conductor (braided wire) 30 formed of the braided wire 30 that had covered the radiating portion 14 is folded in a reverse direction (or the outside of the braided wire 30 is covered with a coaxial circular tube) to obtain a sleeve 10. Each of the length of the radiating portion 14 and the length of the sleeve 10 is generally set to a length of $\lambda/4$ where $\lambda$ is the wavelength of a radio wave desired to be received, but a sleeve antenna including those having a length of $\lambda/2$ or $\lambda/8$, or another length has also been known.

Moreover, as an improvement to the sleeve antenna 50 having the simplest structure described above, a meander line sleeve antenna using a dielectric print and having two antenna elements that are small and provide high gain is disclosed (for example, refer to PTL 1).

Moreover, a wide-band and high-gain earphone antenna that reduces an influence on the human body is disclosed, and a portable radio apparatus that ensures stability of reception is also disclosed (for example, refer to PTLs 2 and 3).

CITATION LIST

Patent Literature

PTL 1: JP-A-2002-141732

PTL 2: JP-A-2005-348252

PTL 3: JP-A-2005-64742

SUMMARY OF INVENTION

Technical Problem

However, although many conventional sleeve antennas 50 are used because the structure is simple and the cost is low, the antenna needs, when accommodated in a device, a constant length in a straight direction, and therefore is unsuitable for a reduction in the size of the device.

Solution to Problem

The invention has been made to solve at least a part of the problem described above, and can be realized as the following modes or application examples.

APPLICATION EXAMPLE 1

A sleeve antenna according to this application example includes: a coaxial feed line; a radiating portion that has a predetermined length and results from removing an outer conductor at a tip portion of the coaxial feed line; and a sleeve that has a predetermined length and covers the coaxial feed line from a proximal end of the radiating portion toward a direction opposite to the radiating portion, wherein at least one of the radiating portion and the sleeve has a bent portion in at least a portion thereof.

According to the application example, since at least one of the radiating portion and the sleeve of the sleeve antenna has the bent portion in at least a portion thereof, the sleeve antenna can be attached to a chassis while maintaining favorable antenna gain even when using, for example, a small circuit board. Hence, compared to the case where a conventional sleeve antenna that needs a constant length in a straight direction is attached to a chassis, the degree of freedom in design is increased, which reduces an influence on the surrounding structures of the sleeve antenna. Therefore, it is possible to reduce the size of a device that accommodates the sleeve antenna. In the application example, the angle of bend is not particularly limited, and the term bend means a bend with which the sleeve antenna can be attached to, for example, a chassis while maintaining favorable antenna gain.

APPLICATION EXAMPLE 2

The sleeve antenna according to the application example, wherein the bent portion is composed of a substantially L-shaped or a substantially U-shaped curved portion or folded portion.

According to the application example, a bent state of the sleeve antenna can be fit to, for example, the position or shape of a member arranged in the vicinity of the sleeve antenna.

APPLICATION EXAMPLE 3

A wireless communication device according to this application example includes: the sleeve antenna according to the application example; a chassis; and a circuit board that has a connection terminal and is accommodated in the chassis, wherein the sleeve antenna is connected to the connection terminal of the circuit board, and at least one of the sleeve and the coaxial feed line of the sleeve antenna is held to at least one of the circuit board and the chassis.

According to the application example, since at least one of the radiating portion and the sleeve of the sleeve antenna has the bent portion in at least a portion thereof, the sleeve antenna can be attached to the chassis while maintaining favorable antenna gain even when using a small circuit board. Hence, compared to the case where a conventional sleeve antenna that needs a constant length in a straight direction is attached to a chassis, the degree of freedom in design is increased, which reduces an influence on the surrounding structures of the sleeve antenna. Therefore, it is possible to reduce the size of a device that accommodates the sleeve antenna. Moreover, since a bent state of the bent portion of the sleeve antenna can be fit to the position or shape of a member arranged in the vicinity of the sleeve antenna, the influence on the surrounding structures of the sleeve antenna is reduced.

APPLICATION EXAMPLE 4

The wireless communication device according to the application example, wherein the chassis has a hole, and the sleeve is inserted into the hole by a desired length.

According to the application example, a distance from a dielectric such as a chassis material is maintained constant, and antenna performance is stabilized. Moreover, by holding a holding member at a distal end of the sleeve of the sleeve antenna, it is possible to reduce an influence of the dielectric of the holding portion on the sleeve antenna (a current distribution of the antenna is not affected).

APPLICATION EXAMPLE 5

The wireless communication device according to the application example comprising a holding member that holds the sleeve antenna, wherein the holding member is provided between at least one of the circuit board and the chassis and a distal end of the sleeve.

According to the application example, the sleeve antenna is arranged in the chassis by providing the bent portion in a portion of the sleeve antenna, and also a proper holding structure is adopted, whereby a distance from a dielectric such as a chassis material is maintained constant, and antenna performance is stabilized. Moreover, by holding the holding member at the distal end of the sleeve of the sleeve antenna, it is possible to reduce an influence of the dielectric of the holding portion on the sleeve antenna (a current distribution of the antenna is not affected).

APPLICATION EXAMPLE 6

The wireless communication device according to the application example, wherein the holding member is formed of a low dielectric constant material.

According to the application example, by holding the sleeve antenna with a low dielectric constant material that allows a radio wave to pass therethrough, it is possible to reduce an influence of the dielectric of the holding portion on the sleeve antenna (a current distribution of the antenna is not affected).

BRIEF DESCRIPTION OF DRAWINGS

FIG. 1 illustrates schematic views showing a configuration of a wireless communication device according to a first embodiment.

FIG. 2 illustrates schematic views showing a configuration of a wireless communication device according to a second embodiment.

DESCRIPTION OF EMBODIMENTS

Hereinafter, embodiments in which the invention is embodied will be described in accordance with the drawings. The drawings used are appropriately enlarged or reduced to be represented so that a portion to be described is brought into a recognizable state.

(First Embodiment)

Figure 1C:
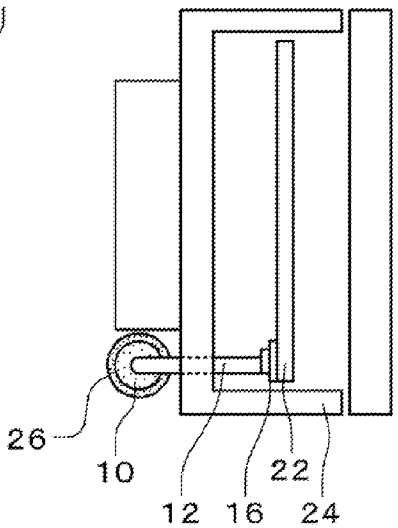
FIG. 1(C) is a schematic right side view.
Figure 1A:
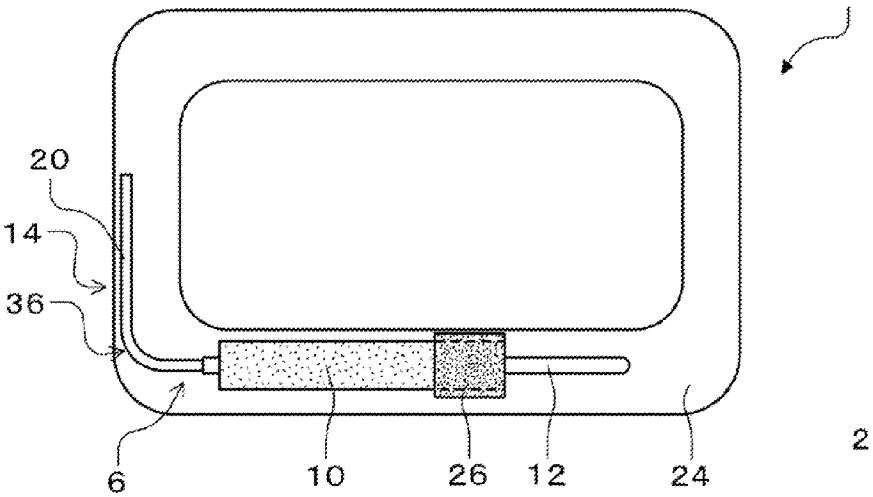
FIG. 1(A) is a schematic plan view.
Figure 1B:
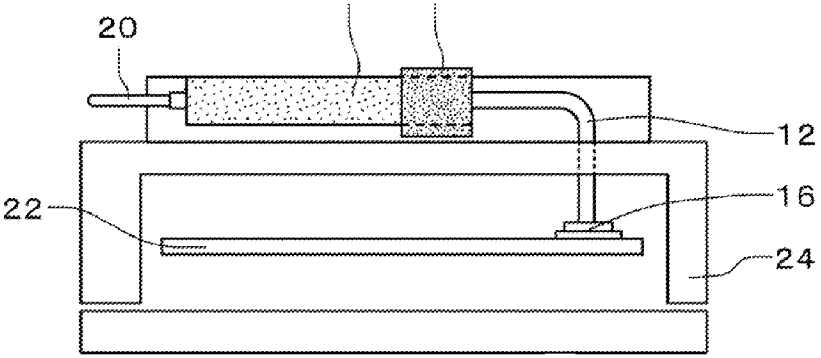
FIG. 1(B) is a schematic elevation view.

FIGS. 1 are schematic views showing a configuration of a wireless communication device 2 according to this embodiment. FIG. 1(A) is a schematic plan view, FIG. 1(B) is a schematic elevation view, and FIG. 1(C) is a schematic right side view. Hereinafter, a structure of the wireless communication device 2 will be described with reference to FIGS. 1.

The wireless communication device 2 according to the embodiment includes a bent-type sleeve antenna (sleeve antenna) 6, a chassis 24, and a circuit board 22.

The bent-type sleeve antenna 6 includes a coaxial feed line 12, a radiating portion 14 that has a predetermined length and results from removing a braided wire 30 at a tip portion of the coaxial feed line 12, and a sleeve 10 that has a predetermined length and covers the coaxial feed line 12 from a proximal end of the radiating portion 14 toward a direction opposite to the radiating portion 14. At least one of the radiating portion 14 and the sleeve 10 has a bent portion 36 in at least a portion thereof. The bent portion 36 is composed of a substantially L-shaped or a substantially U-shaped curved portion or folded portion.

The shape of the bent-type sleeve antenna 6 is not linear in an antenna length direction thereof. In other words, a plurality of bent portions are formed in the antenna length direction. Here, the term bent means that one line has a bent shape with a measurable angle $\alpha$. Moreover, the term curved means that one line has a curved shape so as to warp with a measurable curvature radius R.

The bent-type sleeve antenna 6 is connected to a connector 16 of the circuit board 22. The bent-type sleeve antenna 6 is held to at least one of the circuit board 22 and the chassis 24.

The bent-type sleeve antenna 6 is fixed using an elastic holding member 26 for providing a function as a shock-absorbing material of the bent-type sleeve antenna 6. Moreover, the bent-type sleeve antenna 6 may be fixed using a thermoplastic resin (hot melt), an ultraviolet-curable epoxy, or the like to the chassis 24 made of a plastic.

Figure 9:
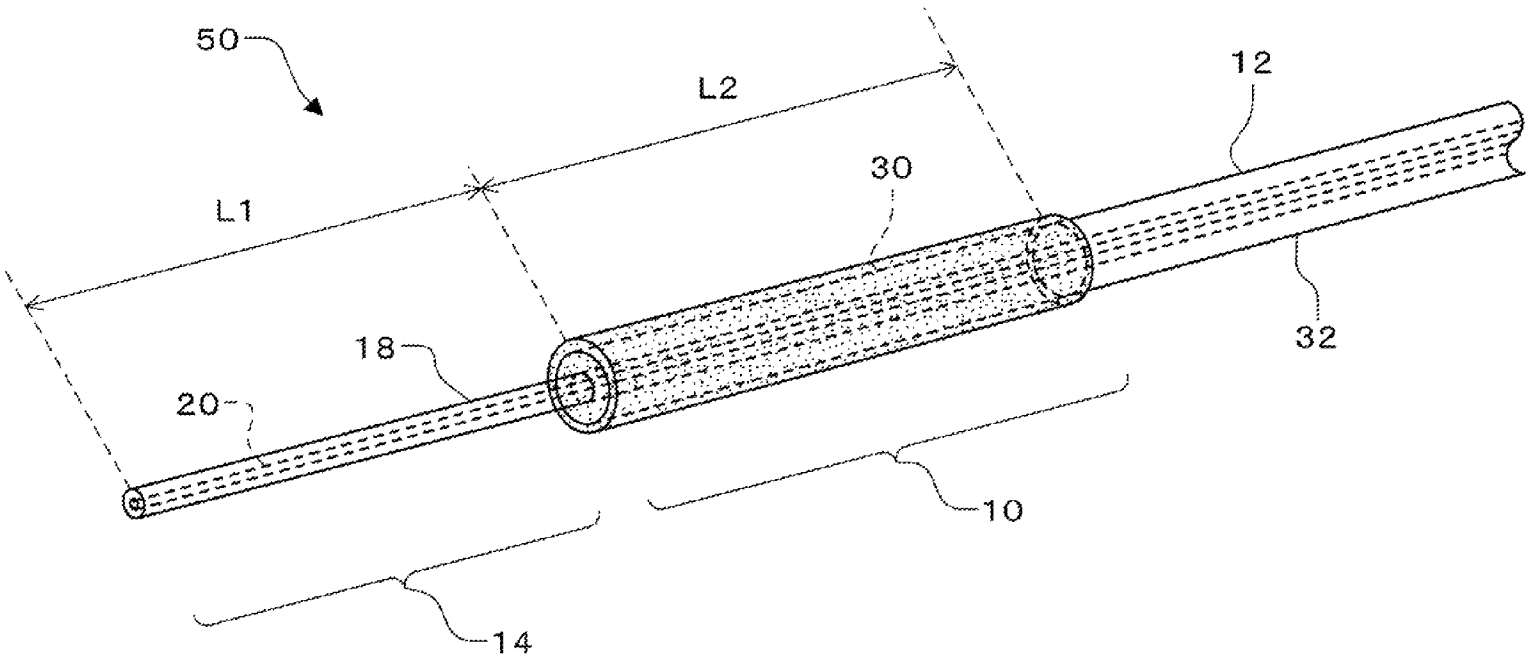
FIG. 9 illustrates an appearance perspective view showing a configuration of a conventional sleeve antenna.

As shown in FIG. 9, the coaxial feed line 12 has a coaxial structure in which a core conductor 20 is covered with an outer conductor (braided wire) 30 via an insulating member 18 and covered with a protective coating 32 at the outermost circumference.

The sleeve 10 is formed of a cylindrical thin-plate conductor having a length about 0.25 times a wavelength to be used, and an upper end thereof is connected to the braided wire 30 by soldering or the like. The sleeve 10 may be formed of any preferred conductive material (for example, a metal such as stainless steel, aluminum, titanium, or copper). The sleeve 10 may have the bent portion 36 in at least a portion thereof The radiating portion 14 is formed to have a length about 0.25 times a wavelength to be used by removing the braided wire 30 from the tip portion of the coaxial feed line 12 exposed from the sleeve 10. Then, the insulating member 18 of the coaxial feed line 12 functions as a member of supporting the core conductor 20 at the radiating portion 14. The insulating member 18 may be removed from the radiating portion 14, and the core conductor 20 may be supported by another supporting member. The radiating portion 14 may have the bent portion 36 in at least a portion thereof. As shown in FIGS. 1, the radiating portion 14 has, at an end on the sleeve 10 side, the bent portion 36 that is bent at about 90 degrees.

At the proximal end of the coaxial feed line 12, a connector (not shown) for connecting with a transmitter or receiver is provided. The connector is composed of a screw portion (not shown) that is electrically conducted to the braided wire 30, a center terminal (not shown) that is electrically conducted to the core conductor 20, and an insulating spacer (not shown) present between the screw portion and the center terminal.

The chassis 24 is a case that covers the circuit board 22, and composed of a raw material (plastic or the like) that allows an electromagnetic wave to pass therethrough.

The circuit board 22 has the connector (connection terminal) 16. The circuit board 22 is accommodated in the chassis 24. The circuit board 22 has a surface on which a circuit for realizing a function of the wireless communication device 2 is formed. An amplifier circuit (not shown) that amplifies the power of an electromagnetic wave to be transmitted from the bent-type sleeve antenna 6 to set transmission power is formed on the circuit board 22. This amplifier circuit radiates, as an electromagnetic wave, the transmission power required for the wireless communication device 2 from the bent-type sleeve antenna 6.

The wireless communication device 2 includes a holding member 26 that holds the bent-type sleeve antenna 6, and the holding member 26 is provided between at least one of the circuit board 22 and the chassis 24 and the distal end of the sleeve 10. According to this, the bent-type sleeve antenna 6 is bent at a portion thereof to provide the bent portion 36 and arranged in the chassis 24, and a proper holding structure is also adopted, whereby a distance from a dielectric such as a material of the chassis 24 is maintained constant and antenna performance is stabilized.

The holding member 26 is a low dielectric constant tube formed of a low dielectric constant material. According to this, by holding the holding member at the distal end of the sleeve 10, it is possible to reduce an influence of the dielectric of the holding portion on the bent-type sleeve antenna 6 (a current distribution of the bent-type sleeve antenna 6 is not affected). The holding member 26 is formed of a soft material (for example, a silicone rubber, a natural rubber, or a synthetic rubber, or other proper elastic compressible materials).

Examples of the low dielectric constant material include, for example, a spin-on glass film containing any one of silica glass, alkylsiloxane polymer, alkylsilsesquioxane polymer, alkylsilsesquioxanehydride polymer, and polyarylether, a diamond film, and a fluorinated amorphous carbon film.

Further, for example, aerogel, porous silica, a gel having magnesium fluoride fine particles dispersed therein, fluorinated polymer, porous polymer, and a predetermined material containing fine particles may be used as the low dielectric constant material.

According to the embodiment, since at least one of the radiating portion 14 and the sleeve 10 of the bent-type sleeve antenna 6 has the bent portion 36 in at least a portion thereof, the bent-type sleeve antenna 6 can be attached to the chassis 24 while maintaining favorable antenna gain even when the circuit board 22 having a small size is used. Hence, compared to the case of attaching to the chassis 24 with the need of a constant length in the straight direction, the degree of freedom in design is increased, which reduces an influence on the surrounding structures of the sleeve antenna. Therefore, it is possible to reduce the size of a device that accommodates the sleeve antenna. Moreover, since a bent state of the bent-type sleeve antenna 6 can be fit to the position or shape of a member arranged in the vicinity of the bent-type sleeve antenna 6, an influence on the surrounding structures is reduced.

(Second Embodiment)

Figure 2C:
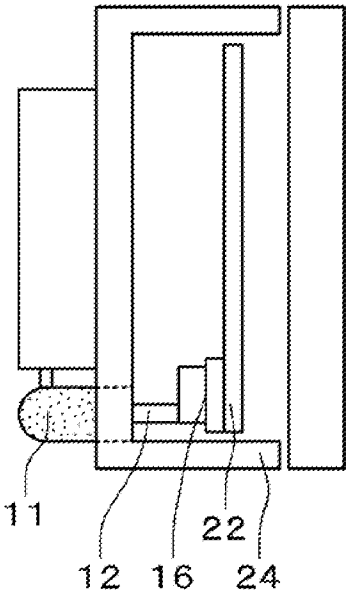
FIG. 2(C) is a schematic right side view.
Figure 2A:
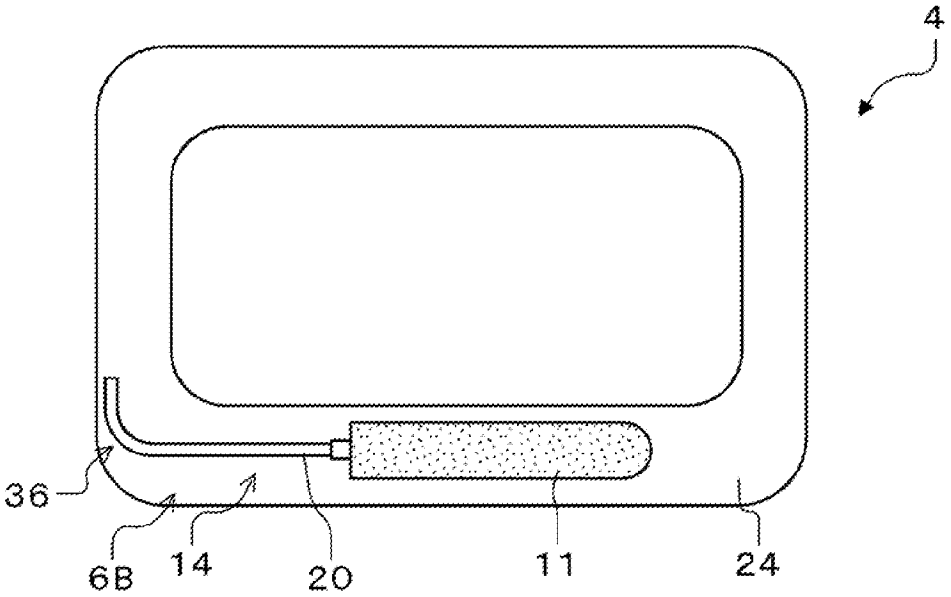
FIG. 2(A) is a schematic plan view.
Figure 2B:
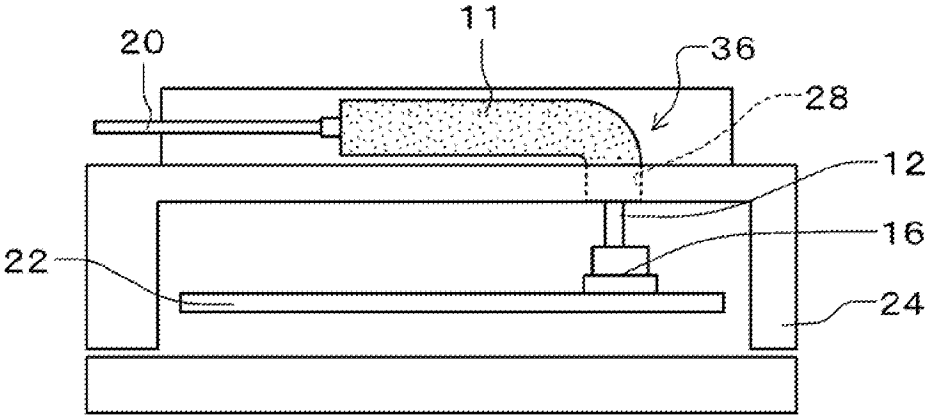
FIG. 2(B) is a schematic elevation view.

FIGS. 2 are schematic views showing a configuration of a wireless communication device 4 according to this embodiment. FIG. 2(A) is a schematic plan view, FIG. 2(B) is a schematic elevation view, and FIG. 2(C) is a schematic right side view. Hereinafter, a structure of the wireless communication device 4 will be described with reference to FIGS. 2. In the drawings, the same constituent portions as those of the first embodiment described above are represented by the same reference numerals and signs, and the description thereof is omitted. Moreover, a difference between a bent-type sleeve antenna 6B of the second embodiment and the bent-type sleeve antenna 6 of the first embodiment is that in the second embodiment, a sleeve 11 is provided so as to be inserted into a hole 28 of the chassis 24 by a desired length from an end of the sleeve 11 on the side opposite to its proximal end, instead of the low dielectric constant tube 26 in the first embodiment. The length of this sleeve 11 is also set to the same length as that of the first embodiment.

In the above first and second embodiments, the length of each of the radiating portion 14 and the sleeves 10 and 11 is set to a length of $\lambda/4$ where $\lambda$ is the wavelength of a radio wave desired to be received, but the length is not limited to this. It is needless to say that the length may be set to $\lambda/2$ or $\lambda/8$, or other lengths.

Embodiments are not limited to those described above, and can be implemented in the following modes.

(Modified Example 1)

Figure 3:
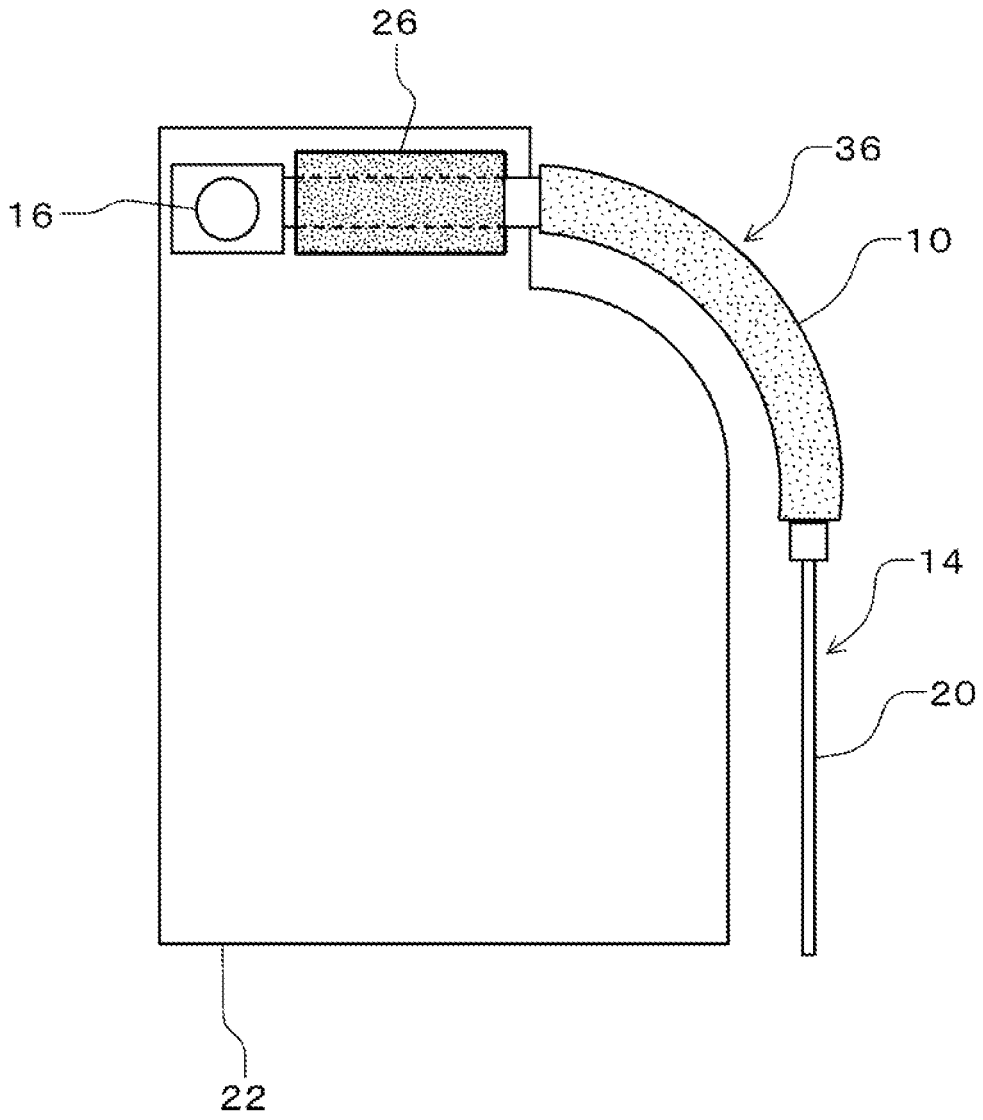
FIG. 3 illustrates a schematic plan view showing a configuration of a bent-type sleeve antenna of Modified Example 1.

FIG. 3 is a schematic plan view showing a configuration of a bent-type sleeve antenna of this modified example.

In the first embodiment described above, the respective shapes of the radiating portion 14 and the sleeve 10 are not limited to that of the radiating portion 14 having the bent portion 36 and that of the sleeve 10 not having a bent portion. Also in the second embodiment described above, the respective shapes of the radiating portion 14 and the sleeve 11 are not limited to that of the radiating portion 14 having the bent portion 36 and that of the sleeve 11 having the bent portion 36. For example, the shape may be the shape shown in FIG. 3. The bent-type sleeve antenna of the modified example includes the radiating portion 14 not having a bent portion that extends along an edge of the circuit board 22, the sleeve 10 having the bent portion 36 that extends along the edge of the circuit board 22, and the coaxial feed line 12 that is connected to the connection terminal 16 of the circuit board 22 and held to the circuit board 22 by the holding member 26. The sleeve 10 has, in the middle, the bent portion 36 that is bent in an arc shape (for example, about ¼ arc).

(Modified Example 2)

Figure 4:
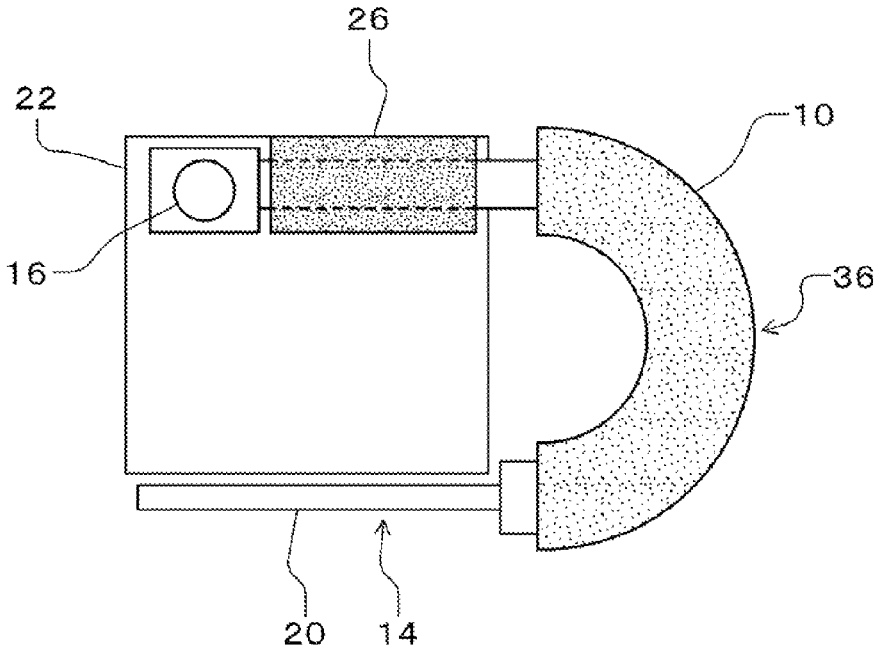
FIG. 4 illustrates a schematic plan view showing a configuration of a bent-type sleeve antenna of Modified Example 2.

FIG. 4 is a schematic plan view showing a configuration of a bent-type sleeve antenna of this modified example.

The bent-type sleeve antenna of the modified example includes the radiating portion 14 not having a bent portion that extends along the edge of the circuit board 22, the sleeve 10 having the bent portion 36 in an arc shape, and the coaxial feed line 12 that is connected to the connection terminal 16 of the circuit board 22 and held to the circuit board 22 by the holding member 26. The sleeve 10 has, in the middle, the bent portion 36 that is bent in an arc shape (for example, about ½ arc).

(Modified Example 3)

Figure 5:
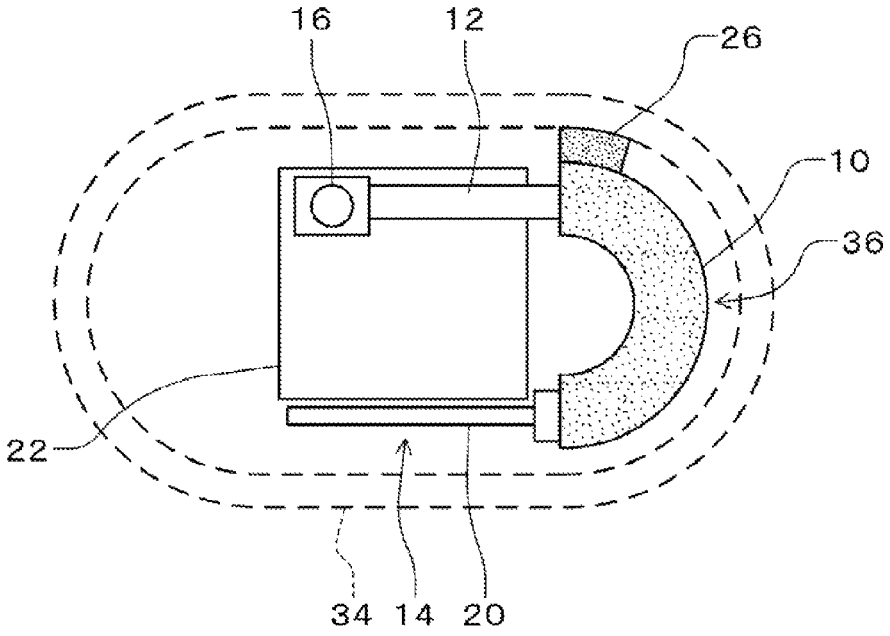
FIG. 5 illustrates a schematic plan view showing a configuration of a wireless communication device of Modified Example 3.

FIG. 5 is a schematic plan view showing a configuration of a wireless communication device of this modified example.

The wireless communication device according to the modified example has a casing 34 and the connector 16, and includes the circuit board 22 that is accommodated in the casing 34, the above-described bent-type sleeve antenna of Modified Example 2 that is held to the casing 34 and connected to the connector 16 of the circuit board 22, and the holding member 26 that holds the bent-type sleeve antenna 6. The sleeve 10 has, in the middle of a cylindrical shape, the bent portion 36 that is bent in an arc shape (for example, about ½ arc). The holding member 26 is provided between the casing 34 and the distal end of the sleeve 10 having the bent portion 36. In the interior of the casing 34, the circuit board 22 and the bent-type sleeve antenna 6 are arranged and each fixed in the interior of the casing 34. The casing 34 has a ring shape whose cross section is rectangular, and is obtained by integrally molding a disk portion composed of a non-conductive material such as a plastic with a bottom surface of a peripheral portion composed of a non-conductive material such as a plastic.

(Modified Example 4)

Figure 6:
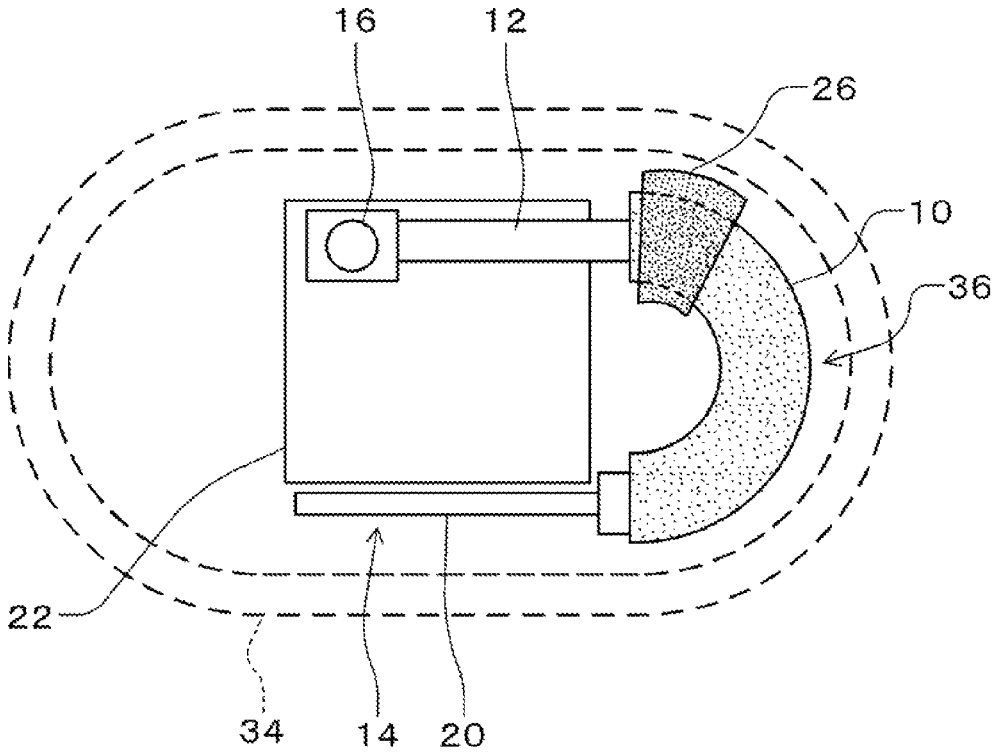
FIG. 6 illustrates a schematic plan view showing a configuration of a wireless communication device of Modified Example 4.

FIG. 6 is a schematic plan view showing a configuration of a wireless communication device of this modified example.

The wireless communication device according to the modified example has the casing 34 and the connector 16, and includes the circuit board 22 that is accommodated in the casing 34, the above-described bent-type sleeve antenna of Modified Example 2 that is held to the casing 34 and connected to the connector 16 of the circuit board 22, and the holding member 26 that holds the bent-type sleeve antenna. The holding member 26 is provided between the casing 34 and the distal end of the sleeve 10 so as to be wrapped around the sleeve.

(Modified Example 5)

Figure 7:
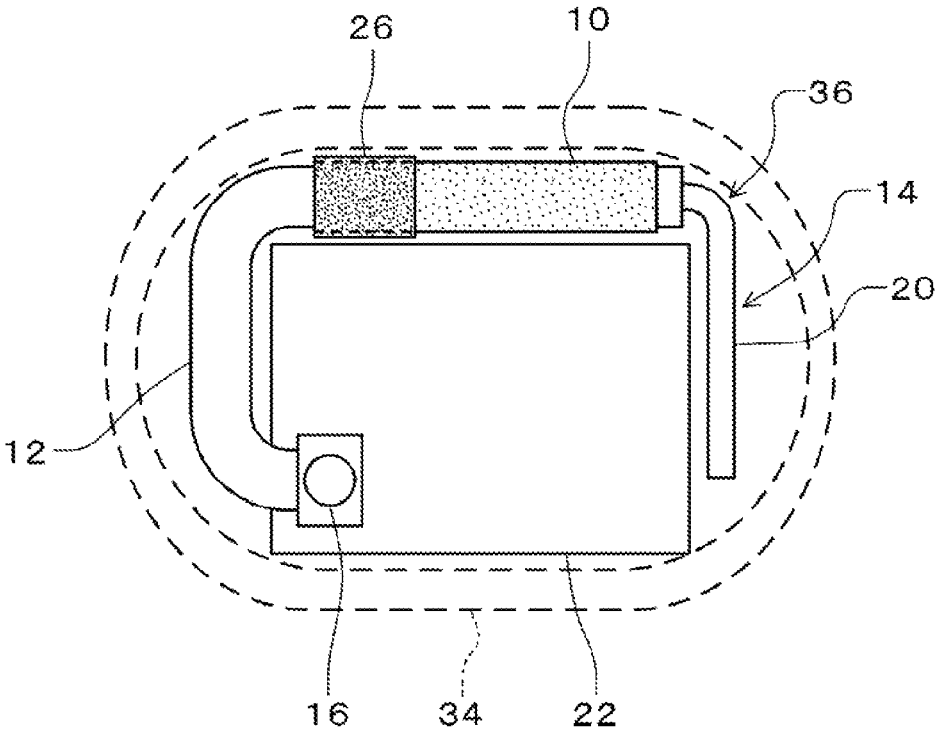
FIG. 7 illustrates a schematic plan view showing a configuration of a wireless communication device of Modified Example 5.

FIG. 7 is a schematic plan view showing a configuration of a wireless communication device of this modified example.

The wireless communication device of the modified example includes the radiating portion 14 having the bent portion 36 that extends along the edge of the circuit board 22, the sleeve 10 not having a bent portion, and the coaxial feed line 12 that is connected to the connector 16 of the circuit board 22 and held to the casing 34 by the holding member 26. The radiating portion 14 has, at the end on the sleeve 10 side, the bent portion 36 that is bend at about 90 degrees. The holding member 26 is provided in a doughnut shape between the casing 34 and the distal end of the sleeve 10 so as to be wrapped around the cylinder of the sleeve.

(Modified Example 6)

Figure 8:
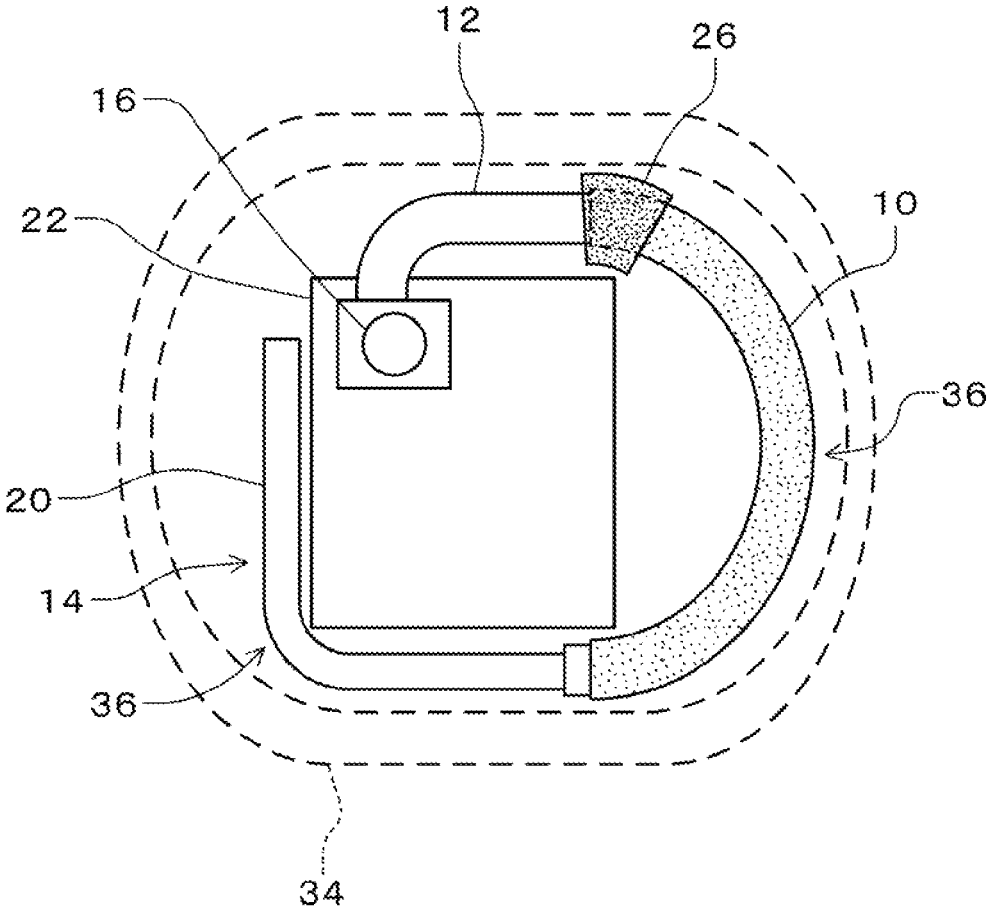
FIG. 8 illustrates a schematic plan view showing a configuration of a wireless communication device of Modified Example 6.

FIG. 8 is a schematic plan view showing a configuration of a wireless communication device of this modified example.

The wireless communication device of the modified example includes the radiating portion 14 having the bent portion 36 that extends along the edge of the circuit board 22, the sleeve 10 having the bent portion 36, and the coaxial feed line 12 that is connected to the connection terminal 16 of the circuit board 22 and held to the casing 34 by the holding member 26. The sleeve 10 has, in the middle portion of a cylindrical shape, the bent portion 36 that is bent in an arc shape (for example, about ½ arc). The radiating portion 14 has, in the middle, the bent portion 36 that is bent at about 90 degrees. The holding member 26 is provided between the casing 34 and the distal end of the sleeve 10 so as to be wrapped around the sleeve.

The sleeve 10 portion of the bent-type may be composed of the braided wire 30 of the coaxial feed line 12. Moreover, the bent-type sleeve antennas 6 and 6B may be applicable to various frequency bands by changing the dimensions thereof. For example, the 2.4 GHz band (WiFi, Bluetooth (registered trademark), Zigbee (registered trademark), GPS, PHS, and the like) and the like can be mentioned.

Moreover, the bent-type sleeve antennas 6 and 6B have a bent shape, and therefore may be arranged either inside or outside the casing 34.

The invention claimed is:

1. A wireless communication device comprising:

a circuit board including a circuit and a connection terminal electrically coupled to the circuit; and a sleeve antenna connected to the connection terminal, comprising:

a coaxial feed line including a core conductor, and an outer conductor, wherein the coaxial feed lines extends between a connector end physically connected to the connection terminal and a first end opposite the connector end, and wherein the coaxial feed line further comprises a first straight section between the first end and the connector end;

a radiating portion, physically connected to and extending from the first end of the coaxial feed line and electrically coupled to the core conductor, the radiating portion including a second straight section; and a sleeve electrically coupled to the outer conductor, wherein the sleeve has a length covering a portion of the coaxial feed line and extending from the first end of the coaxial feed line toward the connector end of the coaxial feed line, wherein the entire length of the sleeve defines a curved portion in an arc shape.

2. The wireless communication device of claim 1, wherein the curved portion includes a 90 degree arc producing a 90 degree angle between the first straight section and second straight section.

3. The wireless communication device of claim 1, wherein the curved portion includes a 180 degree arc causing the first straight section and the second straight section to be parallel.

4. The wireless communication device of claim 1, wherein the radiating portion further includes a third straight section and a bent portion between the second and third straight sections forming a 90 degree angle between the second and third straight sections.

5. The wireless communication device of claim 4, wherein the first, second and third straight sections are on a first plane, and the first plane is parallel to a surface of the circuit board.

* * * * *